US006503466B1

(12) United States Patent
Doelle et al.

(10) Patent No.: US 6,503,466 B1
(45) Date of Patent: Jan. 7, 2003

(54) APPARATUS AND METHOD FOR CHEMICALLY LOADING FIBERS IN A FIBER SUSPENSION

(75) Inventors: Klaus Doelle, Appleton, WI (US); Kurt William Lorenz, Appleton, WI (US); Oliver U. Heise, Menasha, WI (US); Werner Witek, Appleton, WI (US); Robert J. Matz, Appleton, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/130,176

(22) Filed: Aug. 6, 1998

(51) Int. Cl.[7] ..... B01F 3/00
(52) U.S. Cl. ..... 422/229; 422/225; 422/224
(58) Field of Search ..... 162/4, 23, 26, 162/57, 261; 422/224–229

(56) References Cited

U.S. PATENT DOCUMENTS 4,288,288 A * 9/1981 Fleck et al. ..... 162/261
4,350,499 A * 9/1982 Lundgren ..... 95/267
4,878,997 A * 11/1989 Reinhall ..... 162/23
5,223,090 A 6/1993 Klungness et al. ..... 162/9
5,698,667 A * 12/1997 Speaks et al. ..... 530/202

* cited by examiner

*Primary Examiner*—Hien Tran
(74) *Attorney, Agent, or Firm*—Taylor & Aust, P.C.

(57) ABSTRACT

An apparatus for continuously loading fibers in a fiber suspension with a chemical compound includes a deflocculating vessel having an interior chamber, a fluid inlet connected with the interior chamber, a fluid outlet connected with the interior chamber, and a high shear imparting device disposed within the interior chamber for imparting high shear forces to and thereby deflocculating the fiber suspension. A mixing container has an interior compartment, a fluid inlet connected with both the interior compartment and the fluid outlet of the deflocculating vessel, a fluid outlet connected with the interior compartment, and a low shear imparting device within the interior compartment for imparting low shear forces to the fiber suspension. A gas supply is connected with the interior chamber of the deflocculating vessel and/or the interior compartment of the mixing container. The gas supply is configured for supplying a gas to and pressurizing each of the deflocculating vessel and the mixing container.

13 Claims, 1 Drawing Sheet

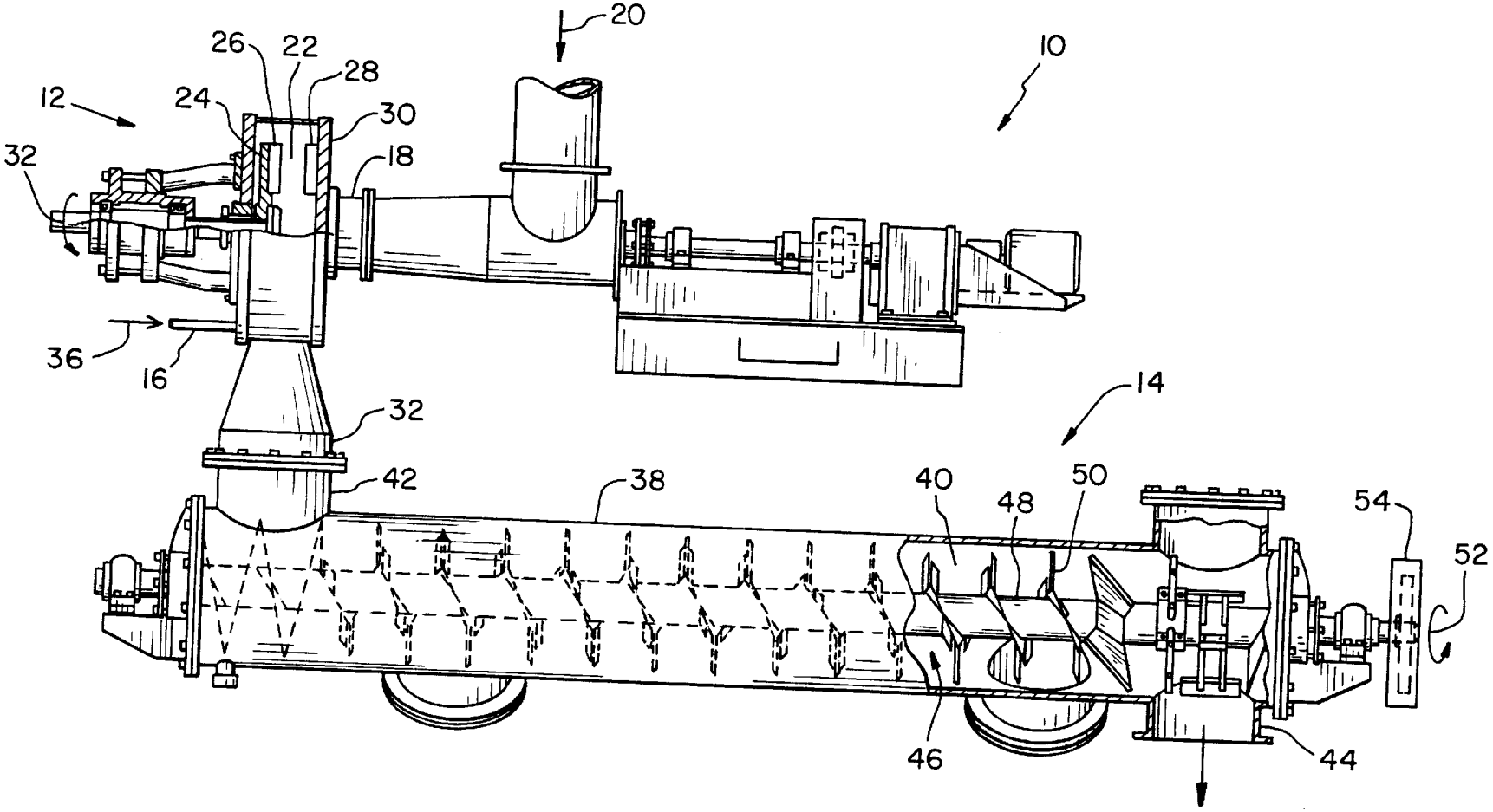
10
12
14
16
18
20
22
24
26
28
30
32
32
36
38
40
42
44
46
48
50
52
54

APPARATUS AND METHOD FOR CHEMICALLY LOADING FIBERS IN A FIBER SUSPENSION

BACKGROUND OF THE INVENTION

1. Field of the Invention

The present invention relates to a method of loading fibers in a fiber suspension for use in a paper-making machine with a chemical compound, and, more particularly, to an apparatus and method for loading fibers in a fiber suspension with calcium carbonate.

2. Description of the Related Art

A paper-making machine receives a fiber suspension including a plurality of fibers, such as wood fibers, which are suspended within an aqueous solution. The water is drained from the fiber suspension and dried in the paper-making machine to increase the fiber content and thereby produce a fiber web as an end product.

The fiber web produced by the paper-making machine typically includes organic wood fibers and inorganic fillers. A known inorganic filler is calcium carbonate, which may be added directly to the fiber suspension (direct loaded calcium carbonate). It is also known to chemically load the fibers within a fiber suspension with calcium carbonate in the lumen and walls of the individual fibers (fiber loaded calcium carbonate). The fiber loaded calcium carbonate increases the strength of the paper compared with a direct loaded calcium carbonate (adding calcium carbonate directly to the fiber suspension) at the same loading (filler) level. This yields an economic advantage in that the filler level of the paper is increased by replacing the more expensive fiber source (wood fibers) with calcium carbonate. The finished paper web has higher strength properties due to the increased filler levels of the calcium carbonate. In contrast, the strength properties of a finished web using direct loaded calcium carbonate is less.

For example, U.S. Pat. No. 5,223,090 (Klungness, et al.) discloses a method for chemically loading a fiber suspension with calcium carbonate. In one described method, calcium oxide or calcium hydroxide is placed within a refiner unit and carbon dioxide is injected into the refiner unit at a specified pressure. The fiber suspension is maintained within the refiner for a predetermined period of time to ensure that a proper chemical reaction and thus proper chemical loading of the fiber suspension occurs. In another described method, a fiber suspension with calcium oxide or calcium hydroxide is introduced into a 20 quart food mixer and carbon dioxide gas is injected into the mixer at a specified pressure. Using either the refiner or the food mixer, both methods utilize a batch processing method for processing only a small amount of the fiber suspension at a time. Because of the large amount of fiber suspension which is required at the wet end of a paper-making machine, a batch process requires that the chemically loaded fiber suspension be transferred to another holding tank for ultimate use in a paper-making machine.

What is needed in the art is an apparatus and a method for chemically loading a fiber suspension for use in a paper-making machine with an adequate output of a chemically loaded fiber suspension which allows commercialization of such a chemical loading process.

SUMMARY OF THE INVENTION

The present invention provides an apparatus and method for continuously loading fibers in a fiber suspension with calcium carbonate using a fluffer for deflocculating the fiber suspension, a series connected auger mixer for mixing the fiber suspension for a predetermined amount of time, and a gas source for pressurizing both the fluffer and mixer with carbon dioxide or ozone.

The invention comprises, in one form thereof, an apparatus for continuously loading fibers in a fiber suspension with a chemical compound. A deflocculating vessel has an interior chamber, a fluid inlet connected with the interior chamber, a fluid outlet connected with the interior chamber, and a high shear imparting device disposed within the interior chamber for imparting high shear forces to and thereby deflocculating the fiber suspension. A mixing container has an interior compartment, a fluid inlet connected with both the interior compartment and the fluid outlet of the deflocculating vessel, a fluid outlet connected with the interior compartment, and a low shear imparting device within the interior compartment for imparting low shear forces to the fiber suspension. A gas supply is connected with the interior chamber of the deflocculating vessel and/or the interior compartment of the mixing container. The gas supply is configured for supplying a gas to and pressurizing each of the deflocculating vessel and the mixing container.

An advantage of the present invention is that the fiber loading of the fiber suspension takes place as a continuous process, thereby providing output quantities of loaded fiber suspension sufficient for use in a paper-making machine.

Another advantage is that variables such as flow rate, temperature and pressure which affect the fiber loading process can be accommodated and varied.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawing, which is a plan, partially sectioned and partially fragmentary view of an embodiment of an apparatus of the present invention for loading fibers in a fiber suspension with a chemical compound. The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown an apparatus 10 for continuously loading fibers in a fiber suspension with a chemical compound such as calcium carbonate. Fiber loading apparatus 10 generally includes a deflocculating vessel 12, a mixing container 14 and a gas supply 16.

Deflocculating vessel 12 receives a fiber suspension at a fluid inlet 18 thereof from a source of fiber suspension, as indicated generally by arrow 20. The fiber suspension which is introduced at fluid inlet 18 includes calcium oxide or calcium hydroxide therein which will subsequently be utilized in a chemical reaction within deflocculating vessel 12 and mixing container 14 to form the calcium carbonate compound, as will be described hereinafter. The fiber suspension introduced at fluid inlet 18 flows into an interior chamber 22. Deflocculating vessel 12 also includes a high shear imparting device in the form of a rotating disc 24 which is disposed within interior chamber 22. Rotating disc 24 includes a plurality of blades 26 which are angularly spaced thereabout and extend in a radial direction relative to the axis of rotation of disc 24. Blades 26 are positioned adjacent to a plurality of angularly spaced and radially extending blades 28 which are rigidly affixed to a side wall 30. Blades 26 and 28 may have any desired cross-sectional shape, such as triangular, rectangular, etc., and may be the same or differently shaped relative to each other. Moreover, blades 26 and 28 may be fixed or movable in an axial direction relative to each other, depending upon whether rotating disc 24 is configured to be movable toward and away from wall 30.

Upon rotation of rotating disc 24, as indicated by arrow 32, blades 26 and 28 impart high shear forces to the fiber suspension within interior chamber 22 which are sufficient to deflocculate the fiber suspension within interior chamber 22. In other words, clumps or crumbles of fibers within the fiber suspension are substantially broken up into individual fibers within interior chamber 22. The deflocculated fiber suspension is then transported from a fluid outlet 32 of deflocculating vessel 12. In the embodiment shown, fluid outlet 32 is configured as an expander with a terminal outlet having a cross-sectional area which is larger than the cross-sectional area adjacent to interior chamber 22. However, fluid outlet 32 need not necessarily be configured as an expander, depending upon the particular application.

Gas supply 16, in the embodiment shown, is configured as a gas line which is directly attached with a side wall of deflocculating vessel 12. Gas supply 16 injects carbon dioxide and/or $O_3$ (ozone) (and optionally steam) into interior chamber 22, as indicated generally by arrow 36. The carbon dioxide and/or ozone (and optionally steam) is injected at a predetermined pressure between approximately 30 and 150 pounds per square inch (psi), preferably approximately 60 psi, whereby interior chamber 22 of deflocculating vessel 12 is pressurized to the predetermined pressure. Since deflocculating vessel 12 and mixing container 14 are connected to each other at fluid outlet 32 in an open manner, pressurizing of interior chamber 22 also results in a substantially equal pressurizing of mixing container 14. Alternatively, it may be possible to provide a baffling arrangement between deflocculating vessel 12 and mixing container 14, whereby interior chamber 22 is pressurized at a higher pressure than mixing container 14.

Mixing container 14, in the embodiment shown, is configured as an auger mixer having a tube 38 defining an interior compartment 40, a fluid inlet 42, a fluid outlet 44 and a rotatable auger 46. Fluid inlet 42 is mechanically connected with fluid outlet 32 of deflocculating vessel 12, and is fluidly connected with interior compartment 40. Fluid outlet 44 is also fluidly connected with interior compartment 40. Auger 46, including central core 48 and segmented or continuous fliting 50, extends between fluid inlet 42 and fluid outlet 44. Fliting 50 terminates slightly prior to fluid outlet 44, and thus the effective working length of auger 46 is less than that of tube 38. Auger 46 imparts a low shear to the fiber suspension which is sufficient to mix or agitate the fiber suspension within interior compartment 40. By the phrase "low shear", it is meant that the shear forces imparted on the fiber suspension within interior compartment 40 are only sufficient to mix the fiber suspension. On the other hand, the phrase "high shear", as used herein with reference to deflocculating vessel 12, means that the shear forces imparted on the fiber suspension are sufficient to deflocculate the fiber suspension.

Auger 46 is rotated (as indicated by arrow 52) at a predetermined rotational speed using a pulley or gear 54. The retention time of the fiber suspension within auger mixer 14, and thus the possible time for the calcium carbonate to be loaded within the fibers of the fiber suspension, is a function of the length of auger 46 between fluid inlet 42 and fluid outlet 44, the pitch of fliting 50 of auger 46, and the rotational speed of auger 46. These physical parameters can of course be varied depending upon the specific application to provide a desired retention time of the fiber suspension within auger mixer 14. Preferably, auger mixer 14 is configured with a retention time of between 2 to 10 minutes, and more preferably between 3 to 6 minutes.

During use, fiber suspension containing calcium oxide and/or calcium hydroxide is introduced through fluid inlet 18 into interior chamber 22 of deflocculating vessel 12. Disc 24 is rotated at a rotational speed which is sufficient to cause blades 26 and 28 to deflocculate the fiber suspension and thereby substantially break up the clumps or crumbs into individual fibers. Carbon dioxide and/or ozone (and optionally steam) is injected into interior chamber 22 at a pressure of approximately 60 psi to thereby pressurize interior chamber 22 to approximately 60 psi. Moreover, each of the fiber suspension and the carbon dioxide and/or ozone (and optionally steam) are introduced at a predetermined temperature which ensures a proper chemical reaction within interior chamber 22. Preferably, each of the fiber suspension and the carbon dioxide and/or ozone are injected at a temperature of between approximately 32 and 392° F., more preferably between 40 and 150° F., even more preferably between 50 and 90° F., and most preferably approximately 68° F. The injected gas reacts with the calcium oxide and/or calcium hydroxide to form calcium carbonate in the lumen and/or walls of the deflocculated fibers within interior compartment 22. The fiber suspension with the injected gas is then transported through fluid outlet 32 to auger mixer 14. The chemical reaction continues to occur within the fiber suspension while the fiber suspension is retained within auger mixer 14. The retention time of the fiber suspension within auger mixer 14 can be varied, as described above. The mixing action within auger mixer 14 maximizes the chemical reaction, and thus the fiber loading of the calcium carbonate within the lumen and walls of the individual fibers. The chemically loaded fiber suspension is then discharged from fluid outlet 44 for further processing.

In the embodiment shown, gas supply 16 is connected near fluid outlet 32 of deflocculating vessel 12. However, it is to be understood that the exact location and/or number of gas injection points into apparatus 10 may vary. That is, gas supply 16 may be fluidly connected in parallel to each of deflocculating vessel 12 and auger mixer 14. Moreover, the exact location of the connection point with deflocculating vessel 12 and/or mixing container 14 may vary. That is, e.g., gas supply 16 may be connected near fluid inlet 18 as opposed to being connected near fluid outlet 32.

The present invention as described above also provides a method for chemically loading a fiber suspension which is more environmentally friendly. To wit, by injecting ozone gas into deflocculation vessel 12, gas which is not utilized in the chemical reaction and which ultimately dissipates from the loaded fiber suspension to the environment has a positive affect on the environment. With concerns about depletion of ozone in the atmosphere, the release of ozone by the fiber loading process of the present invention may in fact have a positive affect on the environment.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for continuously loading fibers in a fiber suspension with calcium carbonate, comprising:

a source of fiber suspension, said fiber suspension including at least one of calcium oxide and calcium hydroxide therein;

a deflocculating vessel having at least one vessel interior chamber, a fluid inlet connected with said source of fiber suspension and each said vessel interior chamber, a fluid outlet connected with each said vessel interior chamber, and a high shear imparting device disposed within each said vessel interior chamber for imparting high shear forces to and thereby deflocculating the fiber suspension;

a mixing container having a container interior compartment, a container fluid inlet connected with each said container interior compartment and said fluid outlet of said deflocculating vessel, a container fluid outlet connected with said container interior compartment, and a low shear imparting device within said container interior compartment configured for imparting low shear forces to the fiber suspension and conveying the fiber suspension continuously through said container interior compartment toward said container fluid outlet, said low shear imparting device and said container fluid outlet together being configured for conveying the fiber suspension continuously outward through said container fluid outlet, said mixer container having a first container end and a second container end, said low shear imparting device having a first device end and a second device end, said first device end being rotatably mounted in said first container end, said second device end being rotatably mounted in said second container end, said low shear imparting device thereby extending at least from said container fluid inlet to said container fluid outlet; and a gas supply connected with at least one said first interior chamber of said deflocculating vessel and with said container interior compartment of said mixing container, said gas supply configured for supplying gas to and pressurizing each of said deflocculating vessel and said mixing container, said gas supply being a source of a gas which promotes the formation of calcium carbonate when mixed with at least one of calcium oxide and calcium hydroxide.

2. The apparatus of claim 1, wherein said high shear imparting device includes a stationary wall with a plurality of fixed blades thereon within each said vessel interior chamber, and a rotating disc with a plurality of blades thereon positioned within each said vessel interior chamber and in association with said fixed blades.

3. The apparatus of claim 1, wherein said low shear imparting device comprises an auger mixer with a tube and an auger positioned within said tube, said fluid inlet of said mixing container positioned at one end of said tube and said fluid outlet of said mixing container positioned at an opposite end of said tube.

4. The apparatus of claim 3, wherein said mixing container includes means for rotating said auger within said tube at a rotational speed, said tube and auger each having a length which with said rotational speed define a retention time of the fiber suspension within said mixing container of between 2 to and 10 minutes.

5. The apparatus of claim 4, wherein said retention time of the fiber suspension within said mixing container is between 3 to and 6 minutes.

6. The apparatus of claim 5, wherein said length of said auger is less than a length of said tube.

7. The apparatus of claim 1, wherein said gas supply comprises a gas line which is directly attached with to said deflocculating vessel.

8. The apparatus of claim 1, wherein said gas supply is configured to pressurize each of said deflocculating vessel and said mixing container at a pressure of between 30 and 150 pounds per square inch.

9. The apparatus of claim 8, wherein said gas supply is configured to pressurize each of said deflocculating vessel and said mixing container at a pressure of approximately 60 pounds per square inch.

10. The apparatus of claim 8, wherein said gas supply is configured to pressurize each of said deflocculating vessel and said mixing container approximately equally relative to one another.

11. The apparatus of claim 1, wherein each of said deflocculating vessel and said mixing container are pressurized at a pressure of approximately 60 pounds per square inch.

12. The apparatus of claim 1, wherein said gas of said source of a gas consists essentially of at least one of carbon dioxide and ozone.

13. The apparatus of claim 1, wherein said gas of said source of a gas includes carbon dioxide.

* * * * *